US005213493A

United States Patent [19]

Iwahori

[11] Patent Number: 5,213,493

[45] Date of Patent: May 25, 1993

[54] SAFETY MECHANISM FOR A LIGHTER

[76] Inventor: Masayuki Iwahori, 15-19, Nakada Honmachi Shizuoka-shi, Shizuoka-ken, Japan

[21] Appl. No.: 879,993

[22] Filed: May 8, 1992

[30] Foreign Application Priority Data

Oct. 17, 1991 [JP] Japan ..... 3-298465

[51] Int. Cl.[5] ..... F23D 11/36

[52] U.S. Cl. ..... 431/153; 431/277

[58] Field of Search ..... 431/153, 276, 277

[56] References Cited

U.S. PATENT DOCUMENTS 5,090,893 2/1992 Floriot ..... 431/153

5,125,829 6/1992 McDonough et al. ..... 431/153

FOREIGN PATENT DOCUMENTS 3501647 3/1991 Japan .

*Primary Examiner*—Carroll B. Dority

*Attorney, Agent, or Firm*—Harrison & Egbert

[57] ABSTRACT

A safety mechanism for a lighter which mechanism makes it difficult for infants or children to create a fire with the lighter. The safety mechanism comprises a safety member of a synthetic resin disposed under the rear portion of a gas lever. The safety member includes a frame and a lock portion. The lock portion being connected to said frame through hinge portions provided at two ends of said lock portion. The lock portion is bendable forward and backward at a hinge portion provided intermediately in the lock portion. The lock portion including an operation projection protruding backward therefrom. The frame being always pushed inward at positions near the hinge portions at two ends of said lock portion. The gas lever having a projection protruding downward therefrom at such a position that the projection of said gas lever is over said lock portion when the lock portion is in a backward bent position. The gas lever is provided at its lower portion with an inclined plane, and the inclined plane being in such a position that the inclined plane pushes the lock portion backward from a forward bent position when the rear portion of the gas lever is pushed downward.

1 Claim, 4 Drawing Sheets

PRIOR ART

SAFETY MECHANISM FOR A LIGHTER

BACKGROUND OF THE INVENTION

1. Field of the Invention

The present invention relates to a safety mechanism for a lighter for cigarettes, cigars, etc. More particularly, it relates to a safety mechanism for a lighter which mechanism makes it difficult for infants or children to create a fire with the lighter.

2. Description of the Prior Art

A lighter designed to make a fire by an easy operation is desirable for the proper user of the lighter. However, such a lighter is very dangerous when it has come into the hands of infants or children who do not recognize the danger of the lighter. Such infants or children may create a fire with the lighter and get burnt or cause an accidental fire.

In view of the above, Japanese Patent Laid-Open Publication No. Hei 3-501647 (PCT/FR89/00339, WO90/00239) provides a safety mechanism which makes it difficult for infants or children to create a fire with a lighter. As shown in FIG. 6, this safety mechanism comprises a gas lever 1 (A lever for pulling up a gas emission nozzle. When the rear portion of the gas lever 1 is pushed downward, the gas emission nozzle is pulled upward thereby and emits gas.) provided in its rear side wall 2 with a horizontal opening 3 having a certain angular range, a notch 4 cut upward into one end of said opening 3, a stop lever 5 horizontally rotatably disposed under said gas lever 1, one end of said stop lever 5 protruding from said opening 3. When the stop lever 5 is in an unlocked position, which is a position under the notch 4 of said opening 3, as shown in FIG. 6(1), the gas lever 1 is allowed to turn downward. When the stop lever 5 is in a locked position, which is any position in said opening 3 other than said unlocked position, as shown in FIG. 6(2), the stop lever 5 does not allow the gas lever 1 to turn downward. A spiral spring (not shown) is used as a means for automatically returning the stop lever 5 from the unlocked position to the locked position. In this safety mechanism, the user of the lighter creates a fire when he has turned the stop lever 5 from the locked position to the unlocked position against the force of the spiral spring.

However, the safety mechanism described above has the disadvantages that it is complicated in construction and does not work with sufficient reliability.

BRIEF SUMMARY OF THE INVENTION

It is therefore an object of the invention to provide a safety mechanism for a lighter which mechanism has a simple construction.

It is another object of the invention to provide a safety mechanism for a lighter which mechanism has sufficient reliability of operation.

It is a further object of the invention to provide a safety mechanism for a lighter which mechanism minimizes the possibility that infants or children can create a fire with the lighter and at the same time is acceptable for the proper user of the lighter.

These and other objects have been attained by a safety mechanism for a lighter, which mechanism comprises a safety member of a synthetic resin disposed under the rear portion of a gas lever, said safety member comprising a frame and a lock portion, said lock portion being connected to said frame through hinge portions provided at two ends of said lock portion, said lock portion being bendable forward and backward at a hinge portion provided intermediately in said lock portion, said lock portion having an operation projection protruding backward therefrom, said frame being always pushed inward at positions near said hinge portions at two ends of said lock portion, said gas lever having a projection protruding downward therefrom at such a position that said projection is over said lock portion when said lock portion is in a backward bent position (a position in which the lock portion is bent backward), said gas lever being provided at its lower portion with an inclined plane, said inclined plane being in such a position that said inclined plane pushes said lock portion backward from a forward bent position (a position in which the lock portion is bent forward) when the rear portion of said gas lever is pushed downward.

In the specification and claim of the present patent application, "forward", "backward" and "rear" respectively mean "toward the left", "toward the right" and "right" in FIG. 1.

The operation of the safety mechanism for a lighter according to the present invention will now be described.

When the lighter is not used, the lock portion of the safety member is in said backward bent position. This is because when the gas lever was pushed downward in the previous igniting operation the inclined plane provided at the lower portion of the gas lever pushed the lock portion backward from said forward bent position. When the lock portion is in the backward bent position, the projection of the gas lever is over the lock portion of the safety member. Even if the user of the lighter tries to push the gas lever downward when the lock portion is in the backward bent position, the projection of the gas lever contacts the upper surface of the lock portion and therefore the gas lever does not move downward any more. This means that the gas lever is in a locked state when the lighter is not used.

When the lighter is to be used, the operation projection protruding backward from the lock portion is pushed substantially forward with the thumb for example and then the same igniting operation as in conventional lighters is made. Since the frame is always pushed inward at positions near said hinge portions at two ends of said lock portion, when the operation projection of the gas lever is pushed substantially forward the lock portion quickly moves from the backward bent position (locking position) to the forward bent position (unlocking position) in which the lock portion is away from the projection of the gas lever. Then the gas lever is in an unlocked state and can be turned downward. Now it is possible to create a fire by the same operation as in conventional lighters having no safety mechanism. When the gas lever is pushed downward in the igniting operation, the inclined plane in the lower portion of the gas lever pushes the lock portion backward from the forward bent position and returns the lock portion to the backward bent position (locking position). Since the frame is always pushed inward at positions near said hinge portions at two ends of said lock portion as mentioned above, when the inclined plane in the lower portion of the gas lever pushes the lock portion backward from the forward bent position the lock portion quickly moves from the forward bent position (unlocking position) to the original backward bent position (locking position).

Thus, in the lighter having the safety mechanism of the present invention, the gas lever is usually locked. In order to make a fire, it is necessary to unlock the gas lever by pushing the operation projection of the lock portion substantially forward and then make the same igniting operation as in conventional lighters. This two-step operation makes it difficult for infants or children to create a fire with the lighter having the safety mechanism of the present invention. When the gas lever is turned downward in the igniting operation, the gas lever automatically returns to the original locked state.

The safety mechanism for a lighter according to the present invention has a simple construction and sufficient reliability of operation. Furthermore, the safety mechanism of the present invention is acceptable for the proper user of the lighter.

DETAILED DESCRIPTION

The present invention will now be described in detail with reference to the attached drawings.

Figure 1:
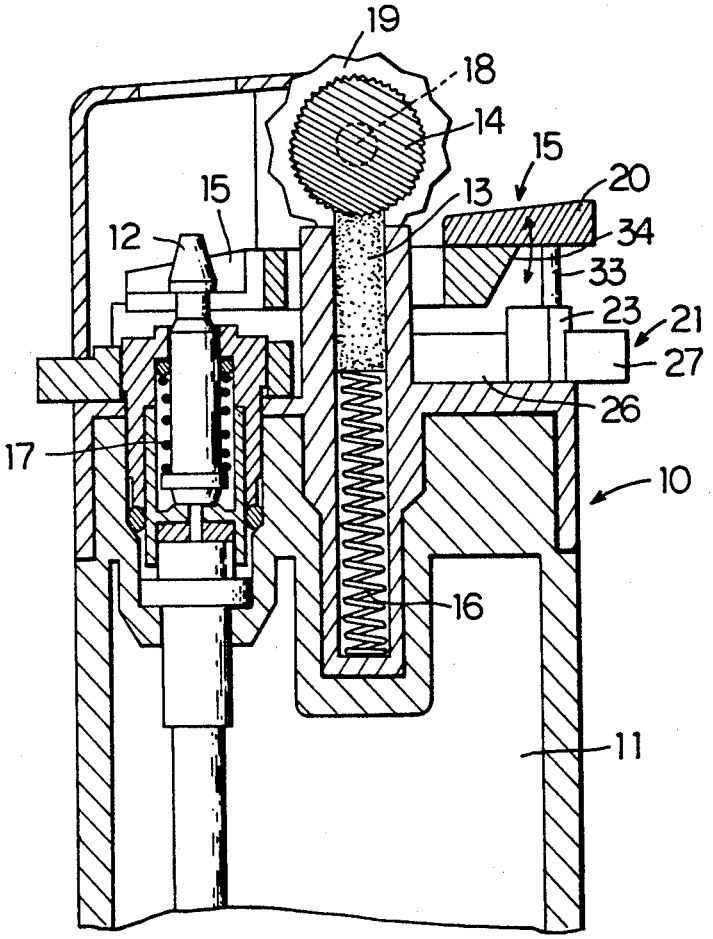
FIG. 1 is a sectional view of a lighter having a safety mechanism of the present invention.

A lighter in which a safety mechanism of the present invention is incorporated will be described first with reference to FIG. 1. This lighter comprises a lighter body 10, a fuel well 11 disposed within said lighter body 10, a gas nozzle 12 through which fuel in said fuel well 11 is emitted, a flint 13, a striker wheel 14 in contact with said flint 13, a gas lever 15 for raising said gas nozzle 12 to emit fuel, a compression spring 16 pushing said flint 13 upward against said striker wheel 14, and a return spring 17 for returning said gas nozzle 12 from a raised position. Reference numeral 18 represents a shaft of the striker wheel 14, and reference numeral 19 represents an auxiliary wheel provided on each of the two sides of said striker wheel 14. The lighter described above makes a fire if the striker wheel 14 is rotated by rotating the auxiliary wheels 19 with the thumb for example and almost simultaneously the rear portion 20 of the gas lever 15 is pushed downward with the same thumb. Then, sparks are emitted by the friction between the flint 13 and the striker wheel 14 and fuel is emitted through the gas nozzle 12 raised by the gas lever 15. Therefore, the fuel catches fire.

Figure 2A:
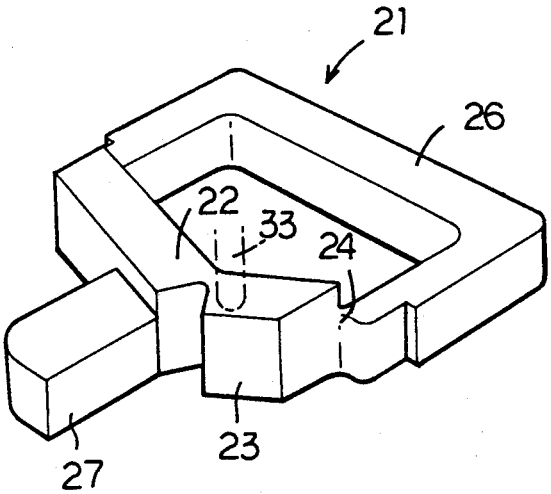
FIG. 2 is a perspective view of a safety member.
Figure 2B:
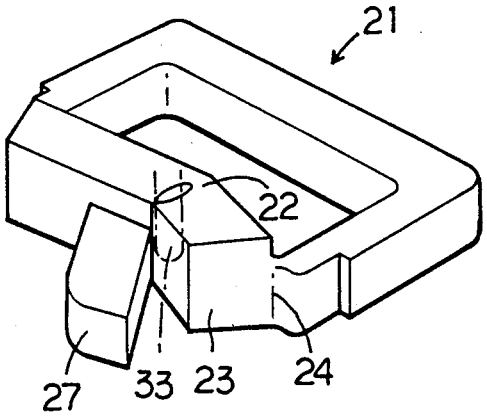
Figure 3A:
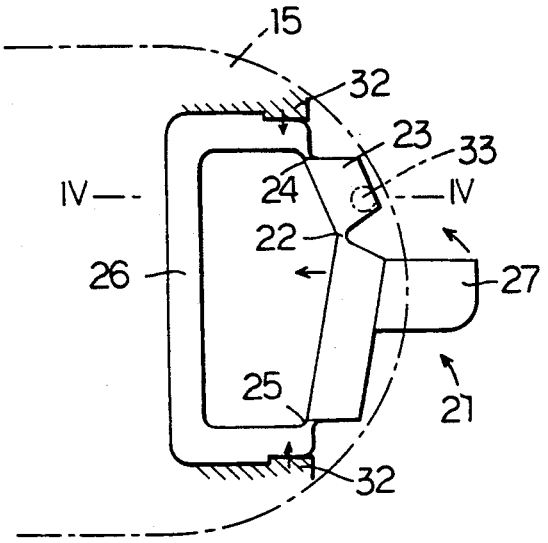
FIGS. 3(1) and 3(2) are plan views of said safety member.
Figure 3B:
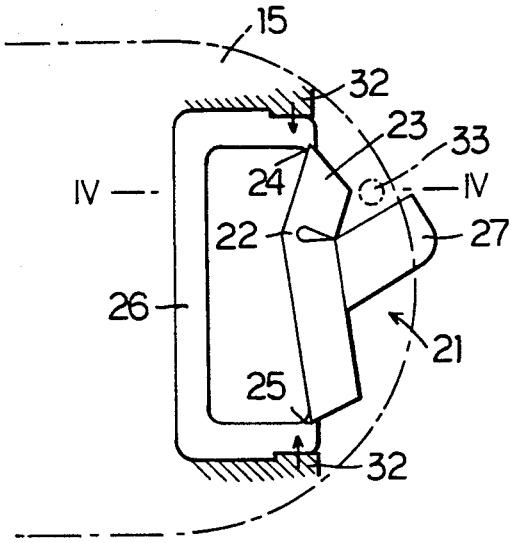
Figure 5:
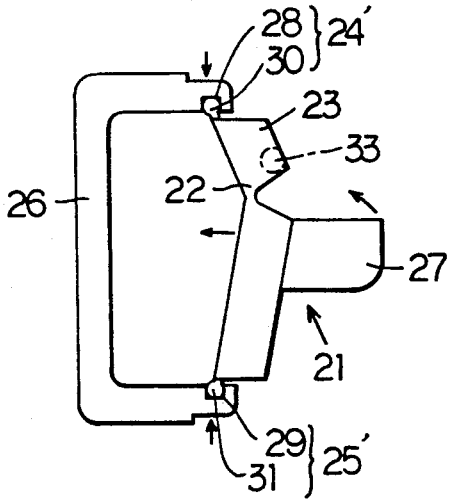
FIG. 5 is a plan view showing a modified safety member.
Figure 4A:
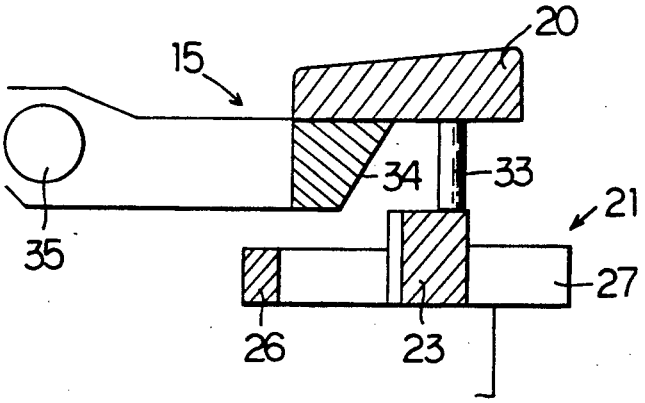
FIGS. 4(1)–4(4) are sectional views showing the relationship between a gas lever and the safety member.
Figure 4B:
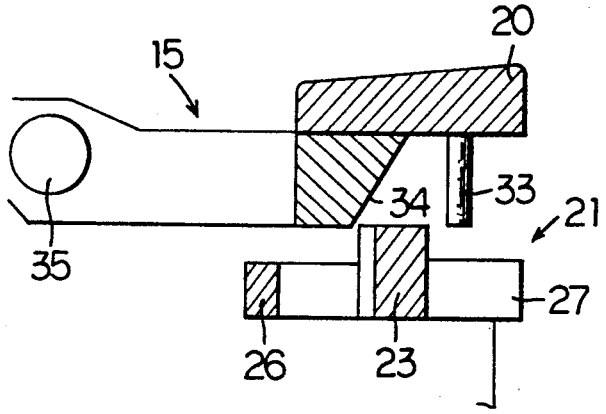
Figure 4C:
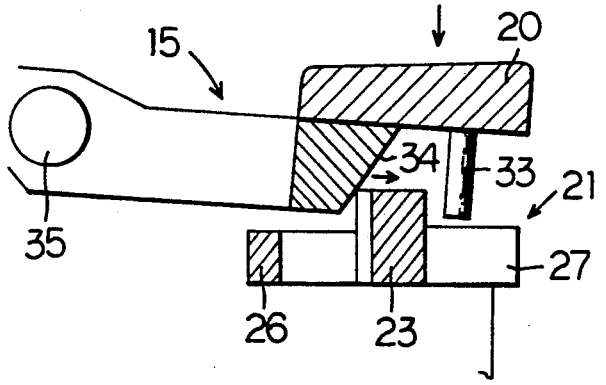
Figure 4D:
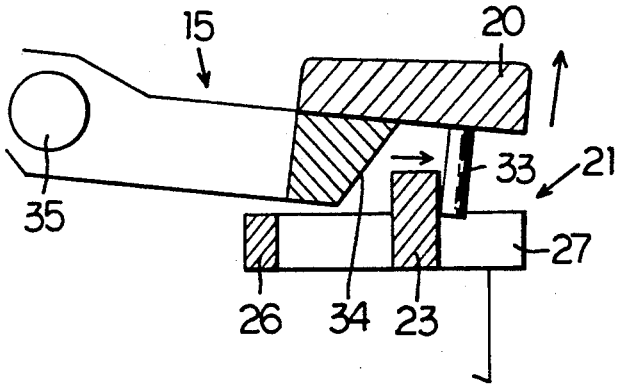
Figure 6A:
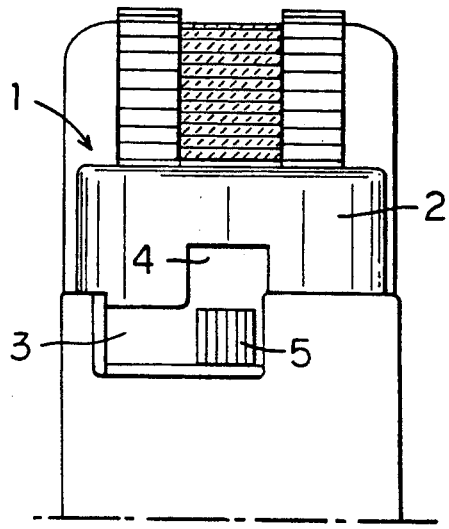
FIGS. 6(1) and 6(2) are rear views showing a conventional safety mechanism.
Figure 6B:
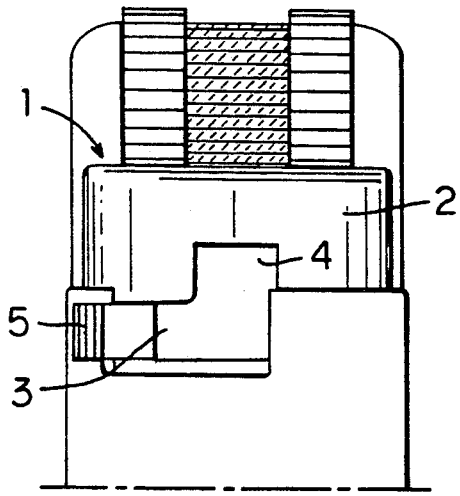
PRIOR ART FIG. 6B

Now a safety mechanism of the present invention incorporated in the lighter mentioned above will be described. A safety member 21 made of a synthetic resin is disposed under the rear portion 20 of the gas lever 15. The safety member 21 comprises a frame 26 and a lock portion 23, said lock portion 23 being connected to said frame 26 through hinge portions 24, 25 provided at two ends of said lock portion 23, said lock portion 23 being bendable forward and backward at a hinge portion 22 provided intermediately in said lock portion 23, said lock portion 23 having an operation projection 27 protruding backward therefrom. The safety member 21 is preferably made of an olefinic resin and preferably in one body. As shown in FIG. 5, however, the safety member 21 may alternatively comprise a frame 26 and a lock portion 23 having an operation projection 27, said frame 26 and lock portion 23 being separate bodies from each other. In this safety member 21, the lock portion 23 is connected to the frame 26 through hinge portions 24', 25' comprising sockets 28, 29 formed at the ends of the frame 26 and projections 30, 31 formed at the ends of the lock portion 23, said projections 30, 31 being inserted into the sockets 28, 29. In any case, the frame 26 is always pushed inward at positions near said hinge portions 24, 25 (24', 25') at two ends of the lock portion 23 by pressing members 32, 32 such as pressing walls. Said gas lever 15 has a rodlike projection 33 protruding downward therefrom at such a position that the projection 33 is over the lock portion 23 as shown in FIG. 2(1) and FIG. 3(1) when the lock portion 23 is in a backward bent position (a position in which the lock portion 23 is bent backward). The gas lever 15 is further provided at its lower portion with an inclined plane 34, said inclined plane 34 being in such a position that the inclined plane 34 pushes the lock portion 23 backward from a forward bent position (a position in which the lock portion 23 is bent forward) when the rear portion 20 of the gas lever 15 is pushed downward. Reference numeral 35 in FIG. 4 represents a shaft of the gas lever 15.

The relationship between the gas lever 15 and the safety member 21 will be further described with reference to FIGS. 4(1)–4(4) etc.

Locked State

The gas lever 15 is in a locked state when the lighter is not used. The lock portion 23 of the safety member 21 is in the backward bent position and the projection 33 of the gas lever 15 is over the lock portion 23. Even if the user of the lighter tries to push the gas lever 15 downward, the projection 33 of the gas lever 15 contacts the upper surface of the lock portion 23 and therefore the gas lever 15 does not move downward any more. In this state, it is impossible to create a fire with the lighter. See FIG. 4(1), FIG. 3(1) and FIG. 2(1).

Unlocked State

The gas lever 15 is turned into an unlocked state when the lighter is to be used. If the operation projection 27 protruding backward from the lock portion 23 is pushed substantially forward, the lock portion 23 quickly moves from the backward bent position (locking position) to the forward bent position (unlocking position) which is away from the projection 33 of the gas lever 15. Then, the gas lever 15 is unlocked and allowed to move downward. In this state, it is possible to create a fire with the lighter. See FIG. 4(2), FIG. 3(2) and FIG. 2(2).

Ignition

When the gas lever 15 is in said unlocked state, the lighter makes a fire if the striker wheel 14 is rotated by rotating the auxiliary wheels 19 with the thumb for example and almost simultaneously the rear portion 20 of the gas lever 15 is pushed downward with the same thumb. See FIG. 4(3).

Automatic Return to Locked State

When the gas lever 15 is pushed downward in the igniting operation, the inclined plane 34 in the lower portion of the gas lever 15 quickly returns the lock portion 23 from the forward bent position (unlocking position) to the original backward bent position (locking position). At the same time, the gas lever 15 is returned to the original position by the force of the return spring 17. See FIG. 4(4).

What is claimed is:

1. A safety mechanism for a lighter comprising a safety member of a synthetic resin disposed under the rear portion of a gas lever, said safety member comprising a frame and a lock portion, said lock portion being connected to said frame through hinge portions provided at two ends of said lock portion, said lock portion being bendable forward and backward at a hinge portion provided intermediately in said lock portion, said lock portion having an operation projection protruding backward therefrom, said frame being always pushed inward at positions near said hinge portions at two ends of said lock portion, said gas lever having a projection protruding downward therefrom at such a position that said projection of said gas lever is over said lock portion when said lock portion is in a backward bent position, said gas lever being provided at its lower portion with an inclined plane, said inclined plane being in such a position that said inclined plane pushes said lock portion backward from a forward bent position when the rear portion of said gas lever is pushed downward.

* * * * *